US008234801B2

(12) United States Patent
Nielsen et al.

(10) Patent No.: US 8,234,801 B2
(45) Date of Patent: Aug. 7, 2012

(54) APPARATUS FOR FEEDING PIECES OF CLOTH

(75) Inventors: Steen Nielsen, Rønne (DK); Henrik Munch Jensen, Nexø (DK); Jonas Birk Hansen, Allinge (DK); Thomas Knöfel, Burgdorf (CH)

(73) Assignee: Jensen Denmark A/S, Ronne (DK)

( * ) Notice: Subject to any disclaimer, the term of this patent is extended or adjusted under 35 U.S.C. 154(b) by 512 days.

(21) Appl. No.: 12/301,311

(22) PCT Filed: May 14, 2007

(86) PCT No.: PCT/DK2007/000228

§ 371 (c)(1),
(2), (4) Date: Sep. 3, 2009

(87) PCT Pub. No.: WO2007/134601

PCT Pub. Date: Nov. 29, 2007

(65) Prior Publication Data

US 2010/0024260 A1 Feb. 4, 2010

(30) Foreign Application Priority Data

May 19, 2006 (DK) ..... 2006 00695

(51) Int. Cl.
*D06F 67/04* (2006.01)
*D06F 67/00* (2006.01)

(52) U.S. Cl. ..... 38/143

(58) Field of Classification Search ..... 38/143; 271/3.14, 3.15, 81, 225, 226; 198/860.1
See application file for complete search history.

(56) References Cited

U.S. PATENT DOCUMENTS

| | | | | |
|---|---|---|---|---|
| 3,468,532 | A * | 9/1969 | Valentine | 271/69 |
| 4,671,001 | A * | 6/1987 | Ferrage et al. | 38/143 |
| 5,440,810 | A * | 8/1995 | Borucki et al. | 38/143 |
| 5,515,627 | A * | 5/1996 | McCabe | 38/143 |
| 2004/0124580 | A1 | 7/2004 | Baboz | |
| 2007/0068433 | A1 * | 3/2007 | Nielsen | 112/141 |

FOREIGN PATENT DOCUMENTS

DE 41 43 070 A1 7/1993

(Continued)

OTHER PUBLICATIONS

International Search Report, PCT/DK2007/000228, 2 pages, dated Sep. 12, 2007.

*Primary Examiner* — Ismael Izaguirre
(74) *Attorney, Agent, or Firm* — Finnegan Henderson Farabow Garrett & Dunner, LLP

(57) ABSTRACT

The present invention relates to an apparatus (1) for feeding pieces of cloth to a device for treating clothes, said apparatus (1) comprising: one or more sets of spreader clamps (20) arranged to be moveable away from each other for straightening of a fore edge of said pieces of cloth and for delivering said piece of cloth to the conveyor (40). At least one set of spreader clamps is configured for performing a movement between a receiving (M) and a delivery (A) position, where the spreader clamps in the receiving position (M) have a first predetermined orientation relative to the conveyor (40); and wherein the spreader clamps (20) in the delivery (A) position have a second predetermined orientation, where the straightened piece of cloth is essentially in parallel with the conveyor (40). Hereby it is accomplished that the pieces of cloth can be received in the spreader clamps (20) from a random feeding position on the charger station (70).

8 Claims, 2 Drawing Sheets

FOREIGN PATENT DOCUMENTS

| | | | | |
|---|---|---|---|---|
| DE | 200 09 588 | U1 | | 9/2000 |
| EP | 0 794 279 | A1 | | 9/1997 |
| EP | 1 160 370 | A2 | | 12/2001 |
| FR | 2 810 344 | A1 | | 12/2001 |
| GB | 002219313 | | * | 12/1989 |

* cited by examiner

APPARATUS FOR FEEDING PIECES OF CLOTH

BACKGROUND OF THE INVENTION

The present invention relates to an apparatus for feeding pieces of cloth to a device for treating clothes, such as a rotary ironer comprising a conveyor with a direction of conveyance configured for conveying the pieces of cloth, said apparatus comprising: one or more spreader devices, each of which has a set of spreader clamps for releasably receiving a piece of cloth from a charger station along an edge and in proximity of a pair of adjacent corners of the piece of cloth, where each spreader device is configured for moving the spreader clamps away from each other transversally of the direction of conveyance for straightening said fore edge and for delivering said piece of cloth to the conveyor.

Apparatuses of this kind, that are also designated feeders, are often used in industrial scale laundries, eg in connection with the feeding of rectangular pieces of cloth, where the pieces of cloth are, in a wrinkled state, fed to the feeder, following which it is spread out with the object of straightening any wrinkles and folds on the piece of cloth prior to the latter being taken to a subsequent clothes treatment device which is most often a rotary ironer. The pieces of cloth will most often be in a more or less moist state when fed to the feeder.

The known feeders of this type comprise a spreader device with a pair of releasable spreader clamps that are movably configured transversally of the direction of conveyance of the feeder, and each of which is configured to secure a corner on a piece of cloth at the fore end thereof and for straightening the fore edge of the piece of cloth when the spreader clamps are taken away from each other to the effect that now the piece of cloth is suspended in straightened state, following which it is subsequently taken to a conveyor for further conveyance.

The piece of cloth is introduced into the clamp in a receiving position (M) with an edge which is transverse relative to the direction of conveyance in proximity of a pair of adjacent corners of the piece of cloth, to the effect that each spreader clamp carries the piece of cloth across an area at the fore edge and, in an essentially horizontal position, is delivered to a transverse vacuum boom where the fore edge is then, in a delivery position (A), laid on the top face of thereof. Subsequently the vacuum boom is shifted with the fore edge in the direction of conveyance, and the now straightened fore edge falls down onto the top face of the conveyor. Hereby it is accomplished that the piece of cloth should preferably be fully straightened prior to it being fed to a subsequently cloth treatment device which will most often be a rotary ironer.

Typically the spreader device is configured in a position in which the piece of cloth may be suspended freely, which is obtained either by providing a pit in the floor underneath the feeder, or by the spreader device being configured at a sufficient height for the piece of cloth to hang down Thus it is also necessary, if the operator is to operate the feeder from a floor level, to configure a charger station to which the piece of cloth is fed and which is configured for conveying the piece of cloth upwards to the spreader device where it is taken over by the spreader clamps. Inasmuch as the spreader device is concerned, such feeder is known from EP 0 794 279.

Moreover, EP 01 160 370 A2 teaches a feeder by which deposition without transition of the piece of cloth directly from the spreader clamps to the conveyor is accomplished without the simultaneous use of a charger station.

However, it is a problem in the context of the known feeders that in particular the combination of spreader device and feeding via a charger station prevents achievement of both good feeding position and simultaneous accomplishment of optimal delivery position. This occurs in particular due to a correct transfer of the piece of cloth between charger clamps and spreader clamps in the receiving position (M) and furthermore the transfer from spreader clamps to the conveyor/boom both make different requirements for obtaining correct feeding when it is simultaneously to be taken into consideration that it must be possible to take up the piece of cloth in a well-defined manner in the spreader clamps and further it must be possible to advance them straightened on the conveyor. Therefore, it has so far been accepted that one cannot use the charger station while simultaneously obtaining an optimal/correct feeding of the pieces of cloth and hence a desired quality of the treated pieces of cloth.

It is the object of the invention to provide an apparatus for feeding pieces of cloth to a clothes treatment device, whereby it is possible to use a charger station and simultaneously obtain an optimal/correct feeding of the pieces of cloth and hence the desired quality of the treated pieces of cloth.

SUMMARY OF THE INVENTION

This is accomplished by the apparatus according to the invention in that the spreader device comprises at least one set of spreader clamps that is configured for performing a movement between a receiving (M) and a delivery (A) position, where the spreader clamps in the receiving position (M) have a first predetermined orientation relative to the conveyor; and wherein the spreader clamps are configured such that the straightened fore edge of the piece of cloth is, in the delivery position (A), essentially in parallel with the conveyor, and one or more charger stations, each of which is configured for receiving a piece of cloth and moving it along a path from a feeding position (L) to a position (M) where the piece of cloth is received by a set of spreader clamps, said path forming a selectable angle to the direction of conveyance of the conveyor.

Hereby it is accomplished that, now, the piece of cloth can be received in the spreader clamps in any predetermined receiving position (M), the spreader clamps being adjustable for receiving the pieces of cloth from charger stations that can be configured at different heights and hence also different positions of introduction (I) irrespective of the angle occupied by the charging station relative to the top face of the conveyor. This is provided by the spreader clamps being configured for receiving the piece of cloth at any angle whatsoever in the receiving position (M) in that spreader clamps and charger clamps engage with each other and hence provide a well-defined delivery of the piece of cloth to the spreader clamps without thereby causing folds to appear on that part of the piece of cloth that is secured in the charger/spreader clamps. Moreover it is enabled by the invention that, in the delivery position (A), a well-defined delivery of the fore edge of the straightened piece of cloth to the conveyor takes place. This is accomplished by the piece of cloth now being deployed directly onto the top face of the boom with the straightened fore edge first, to the effect that also the subsequent part of the piece of cloth will be delivered to the top face of the conveyor in a straightened and well-defined state. The top face of the conveyor is preferably horizontal and thereby the angle at which the pieces of cloth are transferred from the charger station to the spreader clamps is preferable horizontal.

According to a preferred embodiment of the invention, the charger station is configured for conveying the piece of cloth in a rectilinear path, whereby the spreader clamps are, in the receiving position (M), in alignment with the rectilinear path.

Hereby a course of the path of the spreader clamps is obtained which is advantageous in particular cases.

According to a further advantageous embodiment of the invention, the charger station is configured for conveying the piece of cloth along a curve, where the spreader clamps are, in the receiving position (M) in alignment with the tangent of the curve when the piece of cloth is received from the charger station. Hereby results a further advantageous course of a curve travelled by charger clamps in the charger station in cases where eg a decentralised feeding is used with charger stations that, via a conveyor system, conveys pieces of cloth for being fed into the spreader clamps.

Other advantageous embodiments of the invention will appear from the dependent claims.

BRIEF DESCRIPTION OF THE DRAWINGS

The invention will now be explained with reference to the drawing, wherein.

DETAILED DESCRIPTION OF THE INVENTION

Figure 1:
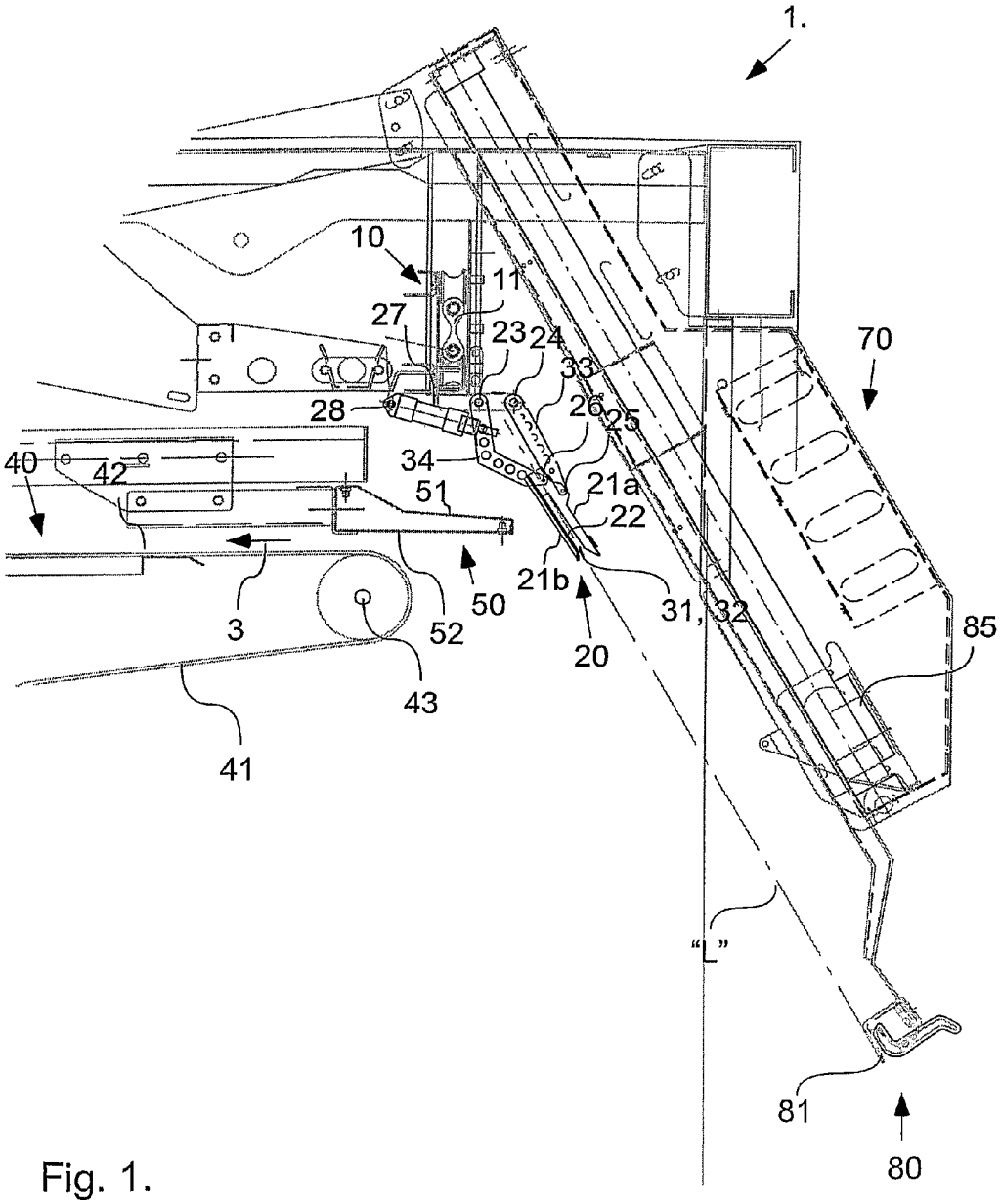
FIG. 1 is a sectional view of a feeder with a spreader clamp in a receiving position (M)
Figure 2:
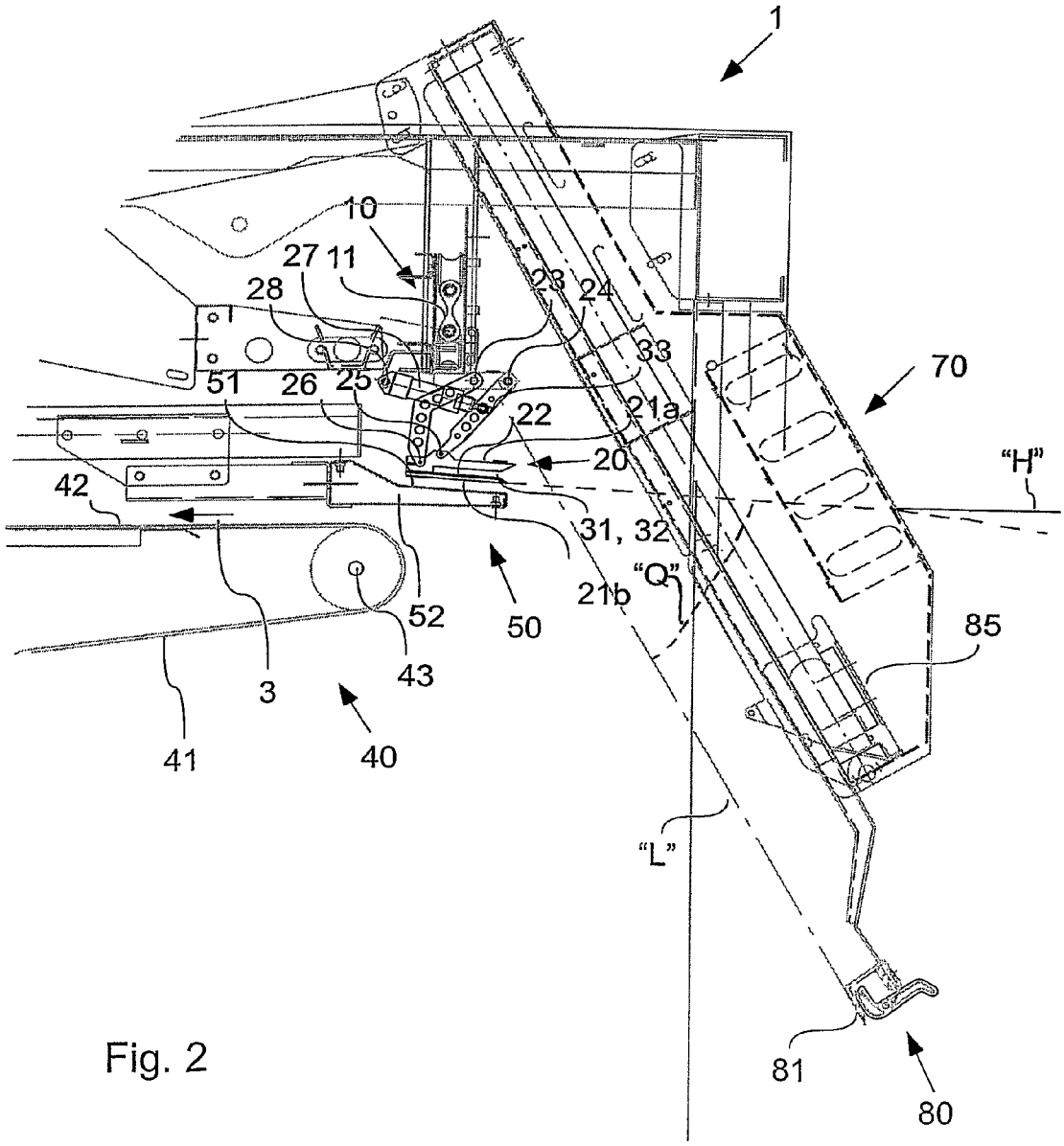
FIG. 2 is a sectional view of the feeder shown in FIG. 1 with the spreader clamp in a delivery position (A).

Thus, with reference to FIGS. 1 and 2, an apparatus/a feeder 1 is thus shown for feeding pieces of cloth to a clothes treatment apparatus, such as a rotary ironer. The feeder comprises a conveyor 40 in the shape of an endless conveyor belt 41 with a direction of conveyance 3, where pieces of cloth that are fed and straightened at the front of the apparatus are taken on the top face of the conveyor belt towards eg a rotary ironer configured at the outlet end (not shown) of the feeder. Above the conveyor 40 and at the introduction end of the feeder, a spreader device 10 is provided.

Thus, FIG. 1 shows the feeder 1 comprising a spreader device 10 with the spreader clamps 20 in a receiving position, ie in a position in which a piece of cloth is received in a spreader clamp 20 via a charger station 70 as described below. In FIG. 2 the feeder is shown with the spreader device 10, where the spreader clamps 20 are in a delivery position (A), ie the position in which the piece of cloth is transferred from the spreader clamps 20 to a vacuum boom 50.

The spreader device 10 consists of a rail 11 that extends transversally of the direction of conveyance 3 of the feeder and on which at least one carrier pair run(s), each of which has two carriages 10*a*, 10*b* that are configured to operate in pairs, in twos. Each of the carriages 10*a*, 10*b* is configured with a releasable spreader clamp 20 for receiving a piece of cloth along a fore edge and in proximity of a pair of adjacent corners of the piece of cloth to be spread, and, when the carriages are driven away from each other, for straightening the piece of cloth along the straightened fore edge. What is to be transferred to the conveyor 40 is a region at the upper edge of the piece of cloth, ie the fore edge, while the remainder of the piece of cloth is suspended in a vertical plane until it is being pulled up onto the conveyor belt and is taken towards the outlet end in a flat, straightened state. Most often at least one spreader device 10 will be configured in connection with each feeder 1; it being understood that it is an option to configure two or more spreader devices in each feeder if it is desired to provide particularly high capacity, and that, simultaneously, two or more sets of spreader clamps 20 on each rail 11 must be provided.

Each of the essentially similarly configured spreader clamps 20 that are shown in different positions in FIGS. 1 and 2, respectively, and of which exclusively the one spreader clamp 20 is visible, comprises a top and a bottom lower jaw 21*a*, 21*b*. These jaws 21*a*, 21*b* are secured relative to each other and between them a clamping mouth 31, 32 is provided that extends oppositely relative to the direction of conveyance 3 of the conveyor 40 (ie rearwards relative to the direction of conveyance 3), and which is configured for securing the fore edge on the piece of cloth in engagement between the jaws. The securing of the piece of cloth in the clamping mouth 31 is provided by the clamping mouth being, at each spreader clamp 20, configured with a pneumatic unit (not shown) in the shape of an inflatable body which, upon inflation, fills the clamping mouth and hence provides a clamping force between the inflatable body and one of the jaws 21*a*, 21*b*. Particular control means are configured in connection with each pneumatic unit for controlling them. This control could be provided in different ways by the person skilled in the art and will not be discussed in further detail herein.

Each of the spreader clamps 20 is pivotal in a vertical plane extending at right angles to the rail 11. Thus, the spreader clamp 20 is configured with two axes of rotation 25, 26 that extend in parallel with the rail 11 and are, via a first or rear and second or fore pivot arm 33, 34 turnably connected to two corresponding axes of rotation 23, 24 on the carriage 10. The carriage 10 is further provided with actuator means 27, such as a dual-acting pneumatic cylinder that is secured to the carriage 10 and to a suitable spot on the arm 33, it being hereby obtained that the clamp can be shifted in a vertical plane in parallel with the direction 3 of the conveyance. Here it will be understood that the geometry of the clamp construction, including the distance between the axes of rotation 23, 24 and 25, 26, the length of the fore and rear arms 34, 33 as well as the point of attachment of the actuator means 27 on the arm 33 and the working range of the arm 33 as such can, in accordance with the invention, be specified within the scope/requirements that exist to the functional areas of the individual feeder, including a feeding position (L) desired by the operator.

In the charger station 70, the charger clamps 80 are mounted on a drivable carriage 85 which can be shifted along an axis "L" between an upper and a lower position, where the piece of cloth is introduced by the operator. Thus the charger station can be configured either for transporting the piece of cloth in a rectilinear path, whereby the spreader clamps are, in the receiving position (M), aligned with the rectilinear path, or the spreader clamps can be configured for conveying the piece of cloth along a curve where the spreader clamps will then, in the receiving position (M), be aligned with the tangent of the curve when the piece of cloth is received from the charger station by a set of spreader clamps. The charger clamps 80 comprise a clamp face 81 which essentially coincides with the axis "L" and is further configured for cooperating, by transfer of the fore edge of the piece of cloth to the spreader clamps 20, with same (spreader clamps 20) in such a manner that the clamping mouth 31, 32 will, in the receiving position (M), extend essentially in a plane in parallel with the axis "L" to the effect that, in an area at the fore edge, the piece of cloth engages with the clamping mouth 31, 32 by transfer of the piece of cloth, said clamping mouth 31, 32 being, in both the receiving position (M) and in the delivery position (A), open in a direction opposite the direction of conveyance 3.

According to a particular embodiment the spreader clamp can be configured at another angle "Q" between the clamp face 22/the axis "L" and the plane "HP" if it is desired to set the charger station 70 at an another angle and hence another feeding position (I). The control means thus further comprise sensor means (not shown) for recording the position of the charger station relative to a well-defined point of reference on the feeder. This will typically mean that the feeding position (I) is determined as a function of the angle "Q", following which the control means are, based on this information, capable of calculating the correct position of the spreader clamp in the receiving position (M) and passing on to the actuator means 27 the message to set in a position, whereby this position is achieved. Hereby the charger clamps 80 and the spreader clamps 20 will be able to engage with each other as described above.

When the fore edge of the piece of cloth is received in the spreader clamps 20, the carriages 10 with the spreader clamps 20 drive away from each other, and the piece of cloth is spread along the fore edge. Preferably this takes place during or after the movement of the spreader clamps 20 to the delivery position, where they are subsequently transferred to a deposit plate 50. In the delivery position (A) the clamping mouth 31, 32 has another predetermined orientation relative to the deposit plate 50 and is configured such that the clamping mouth 31, 32 is, in the delivery position (A), essentially in parallel with the conveyor (40).

Thus, the spreader clamps 20 are configured for being able to perform a movement between a random receiving position (M) and a delivery position (A), wherein, in the receiving position (M), the spreader clamps (20) may assume a predetermined orientation relative to the conveyor (40) and are configured for receiving a piece of cloth in a first, predetermined position in proximity of a pair of adjacent corners on the piece of cloth to the effect that, across an area at the fore edge, the piece of cloth is received in the clamping mouth 31, 32.

Precisely in that the piece of cloth can now be received in the spreader clamps 20 in any predetermined receiving position and delivered in any delivery position (A), the spreader clamps 20 can be configured for receiving the pieces of cloth from charger stations 70 under the various positions or angles in which they may conceivably be arranged, and likewise the spreader clamps 20 are able to receive pieces of cloth from various types of charger stations 70 and simultaneously in a position which is favourable for the operator. At the same time this is extremely relevant in those cases where a larger number of charger stations 70 are configured in connection with each feeder, and where precisely the same spreader clamps 20 are able to receive the piece of cloth from the feeding positions (I), in which the individual charger stations 70 are configured. This may be eg a situation in which charger stations 70 are configured at the feeder simultaneously with decentralised charger stations 70 that feed pieces of cloth on a conveyor system coupled thereto. In particular by the spreader clamps 20 being configured for being adjustable to any desired position, it is possible to feed pieces of cloth from different positions, ie differently configured charger stations, with the same spreader clamps 20, irrespective of the angle at which the pieces of cloth are to be transferred to the spreader clamps 20 in order for them to receive the piece of cloth correctly at an area at the fore edge.

It will be understood that the various positions or angles in which the charger station may conceivably be arranged will preferably be determined already at the point of construction of the machine, to the effect that the different charger stations will be configured in specific positions at the pint of delivery, but where this position may differ from one charger station to another.

The deposit plate 50 is preferably configured as a vacuum boom and is configured between the spreader clamps 20 and the conveyor 40 and is also displaceable in the direction of conveyance 3 of the conveyor 40. The deposit plate/the vacuum boom 50 comprises an essentially horizontal surface 51 and an internal cavity 52 that is is connection with the open via a number of openings (not shown) configured in the top face. The deposit plate/the vacuum boom 50 is further connected to a suitable vacuum source for providing a suction force for temporary attachment of an area at the fore edge of the piece of cloth on the top face 51 of the deposit plate 50.

FIG. 2 shows the feeder 1 in the delivery position where the vacuum boom 50 is ready to take over the area at the fore edge of the piece of cloth from the spreader clamps 20. This takes place in that the deposit plate/boom 50 is conveyed beyond the spreader clamps 20, whereby the piece of cloth, ie the area at the fore edge, is now caused to be situated above the deposit plate 50. Now the temporary attachment of the spreader clamps 20 is released while simultaneously the carriage is shifted transversally of the direction of conveyance 3, the area at the fore edge of the piece of cloth being hereby transferred to the deposit plate 50 by the spreader clamps 20 now losing their temporary grip. Now the vacuum plate 50 is shifted a suitable distance in the direction of conveyance 3, following which the suction force for temporary attachment of the area at the fore edge on the top face 51 is reduced sufficiently for the temporary attachment to be interrupted, and the piece of cloth falls onto the top face 42 of the conveyor 41 for further conveyance towards the outlet end. Hereby it is accomplished that the piece of cloth is completely straightened prior to it being conveyed into a subsequent cloth processing device which is most often a rotary ironer.

In the figure, the spreader clamp 20 is shown in an essentially horizontal position, and likewise the clamping mouth 31, 32 is configured with a horizontal clamping face 22, the lower jaw 21*b* being constructed with low height. The clamping face 22 and the top face 51 of the vacuum boom 50 are constructed to be essentially in parallel and in the preferred embodiment further essentially in parallel with the carrier plane "HP" of the conveyor. Precisely by the clamping face 22 and the top face 51 being essentially in parallel, a particularly good result is obtained of the transfer to the vacuum boom 50, said clamping face 31, 32 of the spreader clamp now having in its entirety the same distance to the top face 51.

The conveyor 40 which is an endless conveyor 41 may either be configured as one single conveyor belt throughout the entire width of the feeder or may be constituted of a whole series of narrow conveyor belts that are arranged throughout the width of the feeder. The conveyor belt 41 extends between two transverse shafts 43, only one of which, however, is shown in the figure.

The transverse rail 11 and the spreader clamps 20 are arranged at a certain height on the feeder, meaning that the entire piece of cloth or a part thereof can be suspended during the feeding procedure, Thus, this arrangement also means that, most often, it is not possible for an operator to feed the pieces of cloth directly to the spreader clamps 20, but that the pieces of cloth are rather fed to the charger clamps 80 on the charger station 70.

The shown embodiment of the invention serves exclusively to illustrate the invention and is not to be seen as a limitation of the scope of protection of the invention. Thus, a person skilled in the art will be able to readily point to other embodiments of the invention. For instance, the spreader clamps 20 could be configured to also receive pieces of cloth from different types of charger stations, including also where the pieces of cloth are fed exclusively via a conveyor system with decentralised charger stations.

The invention claimed is:

1. An apparatus for feeding pieces of cloth to a device for treating clothes, such as a rotary ironer comprising a conveyor with a direction of conveyance configured for conveying the pieces of cloth to the device, one or more spreader devices, each of which has a set of spreader clamps for releasably receiving a piece of cloth along a fore edge and in proximity of a pair of adjacent corners of the piece of cloth, where each spreader device is configured for moving the spreader clamps away from each other transversally of the direction of conveyance for straightening said fore edge and for delivering said piece of cloth to the conveyor at a delivering position, and one or more charger stations, each of which is configured for receiving a piece of cloth and moving it along a path from a feeding position to a position in which the piece of cloth is received by a set of spreader clamps at a receiving position, said path forming a selectable angle to the direction of conveyance of the conveyor, wherein at least one set of spreader clamps has a pair of pivot arms that, as seen in the direction of conveyance of the conveyor, have a fore and rear pivot arm that are pivotally journaled in separate journaling points situated at a distance from each other, one on the spreader clamps and one on a machine part that is secured against movement in the direction of conveyance, and wherein an actuator means is provided between one pivot arm and the machine part to move the one set of spreader clamps along a curved path to the effect that there is only a certain angle between the one set of spreader clamps in their respective receiving and delivery positions.

2. The apparatus according to claim 1, wherein the fore and rear pivot arms have different lengths so that the one set of spreader clamps is able to move between the receiving and delivery positions, the one set of spreader clamps in the receiving position having a predetermined orientation relative to the conveyor and being configured so that the straightened fore edge of the piece of cloth held by the one set of spreader clamps is, in the delivery position, essentially in parallel with the conveyor.

3. The apparatus according to claim 1 or 2, wherein a charger station moves a piece of cloth along a rectilinear path and the set of spreader clamps are, at the receiving position, in alignment with the rectilinear path.

4. The apparatus according to claim 1, wherein a charger station moves a piece of cloth along a curve and the set of spreader clamps are, at the receiving position, in alignment with a tangent of the curve when a piece of cloth is received from the charger station by the set of spreader clamps.

5. The apparatus according to claim 1, wherein the conveyor includes a deposit plate located between the conveyor and the set of spreader clamps, said deposit plate being displaceable in the direction of conveyance of the conveyor and adapted to receive the piece of cloth at the delivering position of the set of spreader clamps, and, during displacement in the direction of conveyance, transferring the piece of cloth to the conveyor.

6. The apparatus according to claim 5, wherein the deposit plate has a top face and an internal cavity, said cavity being open via a number of openings in the top face of the deposit plate and connected to a vacuum source to provide a suction force for temporary attachment of an area of the fore edge of the piece of cloth on the top face of the deposit plate of the conveyor.

7. The apparatus according to claim 1, wherein each charger station has charger clamps for moving it along said path from the feeding position to the receiving position, the apparatus further comprising:

a first sensor means for recording a position of the charger clamps of the charger station relative to a point of reference on the apparatus;

a second sensor means for recording a position of the actuator means for moving the one set of spreader clamps and;

control means for calculating, on the basis of information on the position of the charger clamps of the charger station, a position to be occupied by the actuator means in the receiving position in order for a clamping mouth of the spreader clamps to extend in parallel with an axis (L) of the path of movement of a piece of cloth by the charger clamps so that the one set of spreader clamps and the charger clamps will be able to engage with each other.

8. The apparatus of claim 7, wherein a position of the charger clamps of the charger station, and hence the feeding position in which pieces of cloth are introduced into the charger clamps of the charger station, is determined as a function of an angle (Q), said angle (Q) being the angle between the axis (L) and a plane essentially in parallel with the conveyor, where the axis (L) extends in a longitudinal direction of the charger station between an upper and a lower position, where the pieces of cloth are fed by an operator, to the charger clamps.

* * * * *